US007555796B2

(12) United States Patent
Lewis et al.

(10) Patent No.: US 7,555,796 B2
(45) Date of Patent: Jul. 7, 2009

(54) PRESSURE RELIEVING MATTRESS

(76) Inventors: Jan Anthony Lewis, 234a Bedwas Road, Caerphilly, UK (GB) CF83 3AW; Ian Robert Mahoney, 4 St. Donats Court, Laleston Close, UK (GB) CF15 7QU; Leyton Mark Stevens, 114 Merlin Crescent, Bridgend, UK (GB) CF31 4QN ( * ) Notice: Subject to any disclaimer, the term of this patent is extended or adjusted under 35 U.S.C. 154(b) by 477 days.

(21) Appl. No.: 11/035,121

(22) Filed: Jan. 13, 2005

(65) Prior Publication Data

US 2005/0172414 A1 Aug. 11, 2005

Related U.S. Application Data

(60) Provisional application No. 60/536,069, filed on Jan. 13, 2004.

(51) Int. Cl.
*A47C 17/00* (2006.01)

(52) U.S. Cl. ..... 5/690

(58) Field of Classification Search ..... 5/610, 5/608, 737, 740, 691, 635, 411, 722, 690
See application file for complete search history.

(56) References Cited

U.S. PATENT DOCUMENTS 3,222,697 A * 12/1965 Scheermesser ..... 428/160
4,064,578 A 12/1977 Yamada
4,316,298 A * 2/1982 Russo et al. ..... 5/722
4,517,693 A * 5/1985 Viesturs ..... 5/681
4,639,952 A * 2/1987 Kensinger ..... 5/13
5,860,174 A 1/1999 Failor
6,182,314 B1 * 2/2001 Frydman ..... 5/648
6,230,349 B1 * 5/2001 Silver et al. ..... 5/636
6,282,735 B1 * 9/2001 Stolpmann et al. ..... 5/606
6,286,166 B1 * 9/2001 Henley et al. ..... 5/722
6,345,401 B1 * 2/2002 Frydman ..... 5/636
6,557,198 B1 * 5/2003 Gladney et al. ..... 5/690
6,596,387 B2 * 7/2003 Ogle ..... 428/304.4
6,662,393 B2 * 12/2003 Boyd ..... 5/727
6,739,005 B2 * 5/2004 Davis ..... 5/615
2002/0029425 A1 3/2002 Henley et al.

FOREIGN PATENT DOCUMENTS

DE 2042566 3/1972
EP 0968697 A1 1/2000
GB 2387540 A 3/2003

* cited by examiner

*Primary Examiner*—Patricia L Engle
*Assistant Examiner*—G Y Lee
(74) *Attorney, Agent, or Firm*—Stockwell & Smedley, PSC

(57) ABSTRACT

This invention relates to mattresses, such as a pressure relieving mattress, comprising a base portion and an upper portion overlying the base portion and having an interface between the portions which has a coefficient of friction low enough such that the portions can slide relative to each other. This configuration enables relative movement of the portions, when the mattress is lying on a profiling bed and the bed is being profiled.

23 Claims, 2 Drawing Sheets

PRESSURE RELIEVING MATTRESS

This invention claims priority to U.S. Provisional Application Ser. No. 60/536,069 filed on Jan. 13, 2004.

FIELD OF THE INVENTION

This invention relates to a mattress such as a pressure relieving mattress.

BACKGROUND OF THE INVENTION

It is well known to provide pressure relieving mattresses for hospital beds to reduce the number and severity of pressure sores experienced by immobile patents. Typically such mattresses fall into two classes. Those which comprise foam-based products, which incorporate a profiling on the upper face, and those which are inflatable and work by progressive inflation of successive cells.

Over the years profiling beds, where the head, trunk, and leg portions can be articulated relative to one another, have become more and more popular but mattress design has not satisfactorily coped with these beds.

It is well known that shear and friction are significant contributory factors towards the development of pressure ulcers and, as can be seen in FIG. 1, when a user is present and the bed is profiled, the user is subjected to excessive compression, shear and friction forces as schematically indicated at A-E. The body of the user is effectively pushed along the mattress each time the bed is profiled. In some instances, this movement can be as much as seven or eight inches.

SUMMARY OF THE INVENTION

In one embodiment, the present invention provides a pressure relieving mattress, as shown for example in FIG. 2 comprising a base portion 11*a* and an upper portion 11*b* overlying the base portion and having an interface 11*c* between the portions which has a coefficient of friction low enough such that the portions can slide relative to each other. The mattress of the present invention enables relative movement of the portions, when the mattress is lying on a profiling bed and the bed is being profiled.

In one embodiment, the interface between the upper portion and the base portion is comprised of a material layer having a coefficient of friction sufficiently low such that the pressure relieving portion can slide relative to the base portion, particularly in a longitudinal direction in response to changes in the profile of an underlying bed. In another embodiment of the invention, the mattress further comprises a cover configured to allow the relative movement between the portions, e.g., in a longitudinal direction.

DETAILED DESCRIPTION OF THE INVENTION

Figure 1:
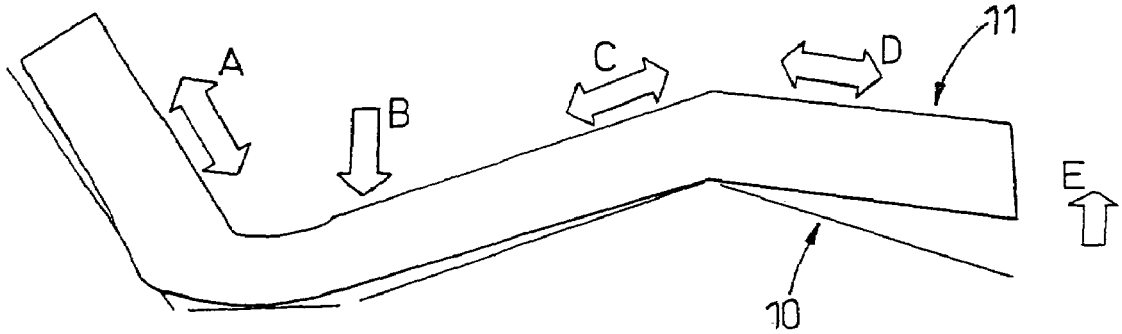
FIG. 1 is a schematic side view of a profiling bed in an articulated position and bearing a standard mattress.

An exemplary embodiment of the present invention consists of a mattress comprising a base portion and an upper portion overlying the base portion characterized in that an interface between the base and upper portions has a coefficient of friction low enough such that the pressure relieving portion can slide relative to the base portion.

Preferably, the interface layer is formed of a material layer having a lower coefficient of friction with the base portion and/or the pressure relieving portion than the two portions would otherwise have with each other.

The interface layer may be separate from the base and pressure relieving portions, or it may be attached to the one or other of the portions. In the latter case, the layer may be sprayed or otherwise deposited on one or other of the portions or adhered thereto. Alternatively, the layer may be integral with one or other of the portions.

Most conveniently, the base and pressure relieving portions can be constituted by foam layers, with the upper or pressure relieving portion typically being profiled. In that case, the integral layer may be formed during the manufacture of the foam layers, for example by forming a smooth surface layer at the interface. Such a smooth surface layer may be in any case desirable if later deposition is to take place. For instance, a polytetraflouroethylene layer could be sprayed onto such a surface.

If a separate layer is used, it will preferably be thin and flexible, such as a polyurethane layer with a suitable coating, so that it does not affect the normal pressure relieving characteristics of the mattress.

From another aspect the invention consists in a mattress comprising a base portion and an upper portion overlying the base portion characterized in that the interface between the portions is formed by a material layer having a lower coefficient of friction with the base portion and/or the upper portion than the two portions would otherwise have with each other.

Such a mattress could have the other characteristics set out above. In any of these cases the upper portion may be a pressure relieving portion and the mattress a pressure relieving mattress.

In any of these cases the mattress may have a cover. Preferably the cover is formed to allow the relative movement between the portions, at least in a longitudinal direction. Indeed it is preferred that the cover principally allows relative longitudinal movement. In any event the cover may be elastically deformable to allow the relative movement and it is particularly preferred the cover is sufficiently resilient to restore the portions to their overlying positions once the force that caused the relative movement is removed and/or the mattress returns to a flat condition. The cover may be any suitable material, such as a polyurethane material. It is preferably breathable and water resistant.

In either of the above aspects the interface may be formed by an intermediate body connected to each portion to allow relative longitudinal movement between the portions.

It is particularly preferred that the body is in the form of at least one partially inflated air sac. The inflation of the air sac is intended to be sufficient to achieve separation of the facing surfaces of the portions to reduce the coefficient of friction between them, without being sufficient to affect the pressure relieving characteristics of the mattress to any clinical extent, e.g. the air sac may not be more rigid than the base portion. Alternatively the body may provide a hinge or pivot point to allow the relative movement, in which case by providing at least partial support for the pressure relieving portion, the coefficient of friction will effectively be reduced.

From another aspect the invention consists in a pressure relieving mattress comprising a base portion and a pressure relieving portion characterised in that the interface between the portions is formed to allow relative longitudinal movement between the portions in response to changes in the profile of an underlying bed.

In any of the above arrangements or those described herein, the portions may have inter-engaging formations to prevent or limit relative lateral movement between them. In a preferred embodiment, these formations are part of a dovetailed joint.

Although the invention has been defined above it is to be understood it includes any combination of the features set out above or in the following description. The invention may be performed in various ways and specific embodiments will now be described by way of example, with reference to the accompanying drawings.

In FIG. 1, a bed, generally indicated at 10, is articulated to place a user in a particular position. As has already been mentioned the effect on the user is to produce shear and friction forces and compression forces as are indicated by the arrows A-E. The compression force at E, is for example, created by the effective upward deflection of the mattress 11 because it does not follow the profiling of the bed 10.

Figure 3:
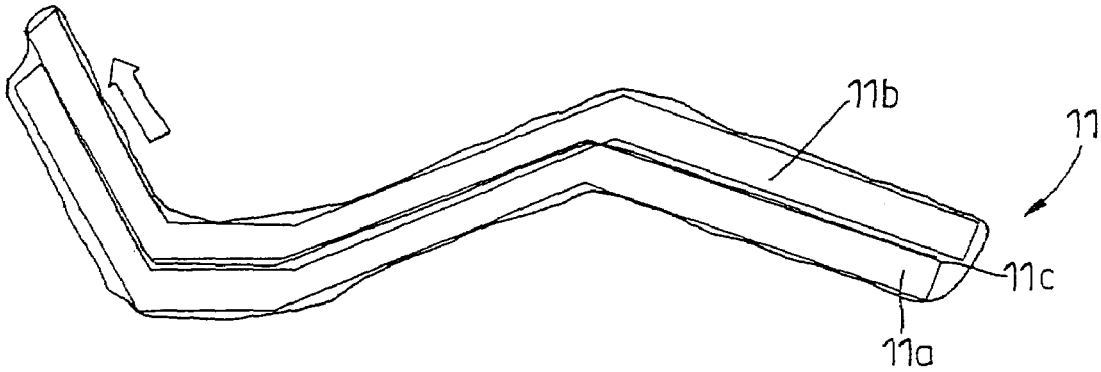
FIG. 3 illustrates the relative movement that can take place between the layers when a bed is profiled as in FIG. 1.

The mattress 11 should be formed of a base portion 11*a* and an upper profiling portion 11*b* with an interface 11*c* between them. The interface 11*c* is designed to allow relative movement between the portions 11*a* and 11*b* when the bed 10 is profiled. Thus, as can be seen in FIG. 3, the upper portion 11*b* slides longitudinally on the base portion 11*b*, because of the reduced friction interface between them. The upper portion 11*b* accordingly moves with the patient, thereby removing friction and shear forces. The mattress as a whole then properly follows the profile of the bed, which in turn reduces any additional forces such as E (FIG. 1). It will be noted in FIG. 3 that the upper portion 11*b* projects beyond each end of the lower portion 11*a*. This is because the lower portion effectively becomes shortened as it takes up the shorter path formed by the bend in the bed profile. This shortening is also facilitated by the relative movement.

The reduced friction layer can be formed in many ways, as discussed above. It could be a sheet of suitably treated polyurethane material stuck to the facing surface of either the base portion 11*a* or the pressure reliving portions 11*b*, or it could be sprayed or otherwise deposited onto that surface. As indicated earlier, the surface may also be formed during the manufacture of the foam, so that it is particularly suitable for receiving such a spray or deposition. A polytetraflouroethylene based surface would, for example, be suitable. It is, however, desirable that the thickness and nature of the interface layer 11*c* is such that it does not interfere with the normal pressure relieving characteristics of the mattress 11.

Figure 2:
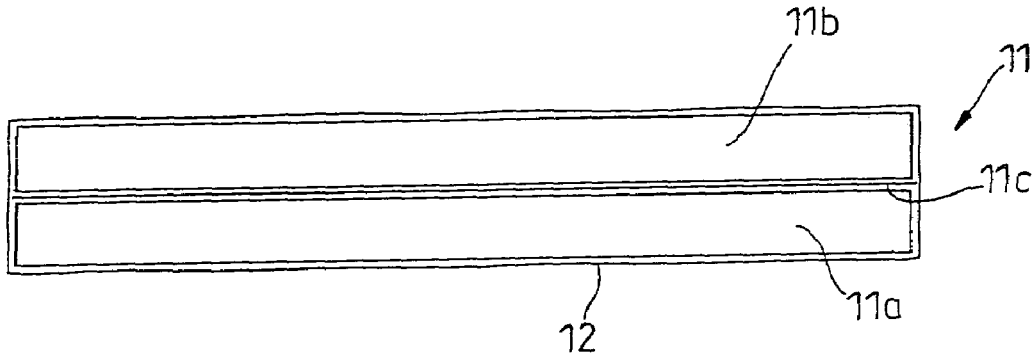
FIG. 2 is a schematic side view of a mattress incorporating a reduced friction layer.

As indicated in FIGS. 2 and 3, the mattress 11 may be provided with a cover 12. This cover 12 is preferably sufficiently elastic to deform locally to allow the relative movement referred to above. The resilience within the material of the cover 12 should return the portions to their overlying positions as shown in FIG. 2, when the mattress 11 once more becomes flat. However, it could also be that the cover is simply somewhat oversized to allow for the necessary movement and the return to the original position may be under the influence of the re-profiling of the bed. Alternatively, some other return provision, such as elastic straps, could also be provided.

Figure 4:
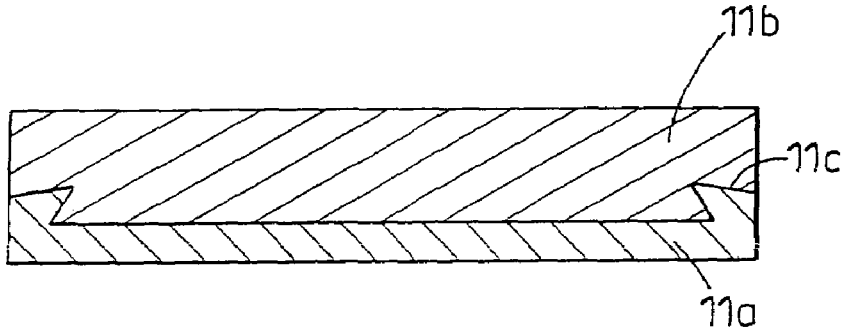
FIG. 4 is a cross-section through a mattress of the type illustrated in FIGS. 1 to 3.

FIG. 4 shows that at the interface 11*c*, the base portion 11*a* and pressure relieving portion 11*b* are formed with respective parts of a dovetailed joint so that lateral movement of the portions is prevented.

Figure 5:
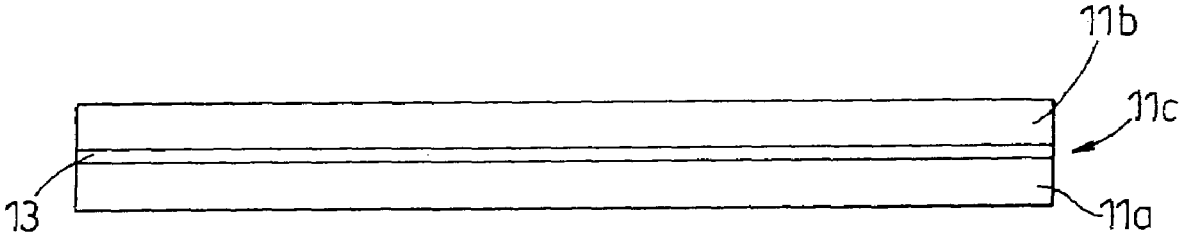
FIG. 5 is a side view of an alternative form of mattress.

FIG. 5 illustrates an alternative embodiment where the interface 11*c* is formed by a partially inflated air sac 13 which extends along the length of the mattress 11 to hold the opposed faces of the portions 11*a*, 11*b* sufficiently apart to reduce friction. The inflation is such that the sac 13 is not more rigid than the base portion 11*a*. It will be understood that a plurality of sacs could replace the single sac 13.

What is claimed is:

1. A mattress for use within a profiling bed comprising a base portion and an upper portion overlying the base portion characterized in that an interface between the portions has a coefficient of friction low enough such that the portions can slide relative to each other.

2. The mattress as claimed in claim 1 wherein the interface is formed by a material layer having a lower coefficient of friction with the base and upper portions than the two portions would otherwise have with each other.

3. The mattress as claimed in claim 2 wherein the layer is separate from the base and upper portions.

4. The mattress as claimed in claim 2 wherein the layer is attached to one of said base and upper portions.

5. The mattress as claimed in claim 4 wherein the layer is deposited on the one or the other of the portions.

6. The mattress as claimed in claim 4 wherein the layer is integral with one of said base and upper portions.

7. The mattress as claimed in claim 1 wherein the interface is formed by an intermediate body connected to each portion to allow relative longitudinal movement between the portions.

8. The mattress as claimed in claim 7 wherein the intermediate body is in the form of at least one partially inflated air sac.

9. The mattress as claimed in claim 7 wherein the intermediate body provides a hinge or pivot point to allow the relative movement.

10. A mattress for use within a profiling bed comprising of a base portion and an upper portion overlying the base portion characterized in that an interface formed between the portions is constituted by a material layer having a lower coefficient of friction with the base and upper portions than the two portions would otherwise have with each other.

11. The mattress as claimed in claim 1 or claim 10 wherein the upper portion is a pressure relieving portion.

12. The mattress as claimed in claim 11, further comprising:

a cover, configured to surround and enclose the exposed surfaces of both upper and lower portions; wherein the cover principally allows relative longitudinal movement.

13. The mattress as claimed in claim 12 wherein the cover is configured to restore the portions to their overlying positions once a force that causes relative movement is removed.

14. The mattress as claimed in claim 11 wherein the cover is elastically deformable to allow the relative movement.

15. The mattress as claimed in claim 1 or claim 10 further including a cover formed to allow relative movement between the portions.

16. The mattress as claimed in claim 15 wherein the cover is sufficiently resilient to restore the portions to their overlying positions once a force that causes relative movement is removed.

17. The mattress as claimed in claim 15 wherein the cover is elastically deformable to allow the relative movement.

18. The mattress as claimed in claim 10 wherein the portions have inter-engaging formations to prevent or limit relative lateral movement between the portions.

19. A pressure relieving mattress for use within a profiling bed comprising a base portion and a pressure relieving portion characterized in that the interface between the portions is formed to allow relative longitudinal movement between the portions in response to changes in the profile of an underlying bed.

20. The mattress as claimed in claim 1 or claim 19 wherein the portions have inter-engaging formations to prevent or limit relative lateral movement between the portions.

21. The mattress as claimed in claim 20 wherein the formations are part of a dovetail joint.

22. A mattress for use within a profiling bed comprising:

a base portion and an upper portion overlying the base portion characterized in that the an interface between the portions has a coefficient of friction low enough such that the portions can slide relative to each other, wherein both base and upper portions further comprise:

a head portion, for supporting the head of a user, a trunk portion, connected to said head portion, for supporting the trunk of the user, and a leg portion, connected to the trunk portion, for supporting the legs of the user, and further wherein the head, trunk, and leg portions of the combined base and upper portions can separately be moved relative to one another.

23. A mattress for use within a profiling bed comprising a base portion and an upper portion overlying the base portion characterized in that an interface between the portions has a coefficient of friction low enough such that the portions can slide relative to each other; and both the base and upper portions also have inter-engaging formations to prevent or limit relative lateral movement therebetween.

* * * * *